United States Patent [19]

Ueda et al.

[11] 4,288,771

[45] Sep. 8, 1981

[54] ELECTROMAGNETIC DRIVEN DEVICE

[75] Inventors: Hiroshi Ueda, Nara; Shigeru Oyokota, Sakai, both of Japan

[73] Assignee: Minolta Camera Kabushiki Kaisha, Osaka, Japan

[21] Appl. No.: 119,775

[22] Filed: Feb. 8, 1980

[30] Foreign Application Priority Data

Feb. 16, 1979 [JP] Japan ..... 54-17586

[51] Int. Cl.[3] ..... H01F 7/08

[52] U.S. Cl. ..... 335/230; 335/236

[58] Field of Search ..... 335/229, 230, 234, 236

[56] References Cited

U.S. PATENT DOCUMENTS 3,302,146 3/1965 Zocholl ..... 335/230
3,755,766 8/1973 Read ..... 335/234
3,775,715 11/1973 Bosch et al. ..... 335/230
4,020,433 4/1977 Uchidoi et al. ..... 335/230
4,238,749 12/1980 Lawson et al. ..... 335/236 X

*Primary Examiner*—George Harris
*Attorney, Agent, or Firm*—Wenderoth, Lind & Ponack

[57] ABSTRACT

An electromagnetically driven device has a coil and a plunger movably inserted in the coil between an inserted and ejected positions. An armature carrying a permanent magnet is provided at one end of the coil for holding the plunger in the inserted position by a magnetic attractive force developed between the armature and the plunger when the coil is deenergized. A yoke is provided between the permanent magnet and the armature for establishing a magnetic circuit therebetween with a predetermined reluctance developed between the armature and the yoke.

16 Claims, 23 Drawing Figures

ELECTROMAGNETIC DRIVEN DEVICE

BACKGROUND OF THE INVENTION

The present invention relates to an electromagnetically driven device and, more particularly, to an improvement of the device.

The present inventors have proposed, in the U.S. patent application Ser. No. 950,518, titled "ELECTROMAGNETIC DEVICE WITH DUST TIGHT ENCLOSURE" and filed on Oct. 11, 1978, an electromagnetic driven device which is diagrammatically shown in FIG. 1. In FIG. 1, a plunger 2 is slidingly inserted into a coil 1 for constituting a solenoid unit. The plunger 2 is urged towards an ejected position by a spring 6, but is normally held in an inserted position as shown by a magnetic attractive force between the plunger 2 and a permanent magnet 4 provided above or on one end of the coil 1. The coil 1 is connected to an electric power supply source including a battery E and a capacitor C which are connected in parallel to the coil 1. During the plunger 2 being held in the inserted position and when the coil 1 is energized, the attractive force acting from the permanent magnet 4 on the plunger 2 is counterbalanced with the magnetic force generated by the coil 1 to such an extent that the attractive force between the permanent magnet 4 and the plunger 2 is reduced or eliminated, thereby permitting the plunger 2 to move towards the ejected position by the biasing force of the spring 6.

In the device shown in FIG. 1, the employment of the permanent magnet 4 in combination with the solenoid unit has such an advantage that the device does not need to employ a mechanical supporting means for supporting the plunger 2 in the inserted position. Thus, the device shown in FIG. 1 is much simpler in construction than the conventional electromagnetically driven devices such as disclosed in U.S. Pat. No. 4,164,721 to Ishida et al., issued Aug. 14, 1979; Japanese Patent Laid-Open Publication No. 129627/1978, published on Nov. 11, 1978; and Japanese Patent Laid-Open Publication No. 619/1979, published on Jan. 6, 1979. All of the electromagnetically driven devices disclosed in these three references employ an electromagnet of a horseshoe configuration.

However, the device shown in FIG. 1 has such a disadvantage that the coil 1 requires a considerably large amount of electric current for generating the counterbalancing magnetic force. In order to enable the device of FIG. 1 to be operable with a limited amount of current the capacitor C having a large capacitance is needed, resulting in a large size of power supplying circuit and a long time interval between two subsequent operations. Such a disadvantage is particularly serious when the device is to be employed in a small size apparatus with a quick sequential operation, such as a camera equipped with a motor drive unit.

SUMMARY OF THE INVENTION

Accordingly, it is a primary object of the present invention to provide an improved electromagnetically driven device which operates with a considerably small current.

It is another object of the present invention to provide an electromagnetically driven device of the above described type which is simple in construction and can be readily manufactured at low cost.

In accordance with a preferred embodiment of the invention, an electromagnetically driven device comprises a coil adopted to be energized by the application of an electric power and a plunger made of magnetic material and inserted in the hollow of the coil for movement in an axial direction of the hollow of the coil between an inserted position and an ejected position. An armature made of magnetic material and having first, second and third faces is positioned at one end of the coil in such a manner that the first face of the armature confronts with one end of the coil. One end of the plunger contacts the first face of the armature when the plunger is moved to its inserted position. A permanent magnet having first and second polar faces is provided on the armature in such a manner that the first polar face of the permanent magnet is held in contact with the second face of the armature for magnetizing the armature. The plunger is held in the inserted position, when the coil is deenergized, by a magnetic attractive force developed between the first face of the armature and the plunger. The plunger is released from the magnetic attractive force in readiness for movement from the inserted position towards the ejected position when the coil is energized to counterbalance the magnetic attractive force.

The electromagnetically driven device further comprising a yoke made of a magnetic material and arranged for establishing main and bypass magnetic circuits, and a means for presenting a predetermined reluctance between the third face of the armature and the yoke for bypassing predetermined flux emanated from the first polar face of the permanent magnet through the armature and the yoke without passing through the plunger to control the magnetic attractive force between the first face of the armature and the plunger.

BRIEF DESCRIPTION OF THE DRAWINGS

The foregoing and other objects, features and advantages of the invention will be apparent from the following description of the invention made with reference to the accompanying drawings in which:

FIGS. 9(*e*) to 9(*j*) are cross-sectional views, showing further methods for controlling the reluctance Rb;

DETAILED DESCRIPTION OF THE INVENTION

Figure 1:
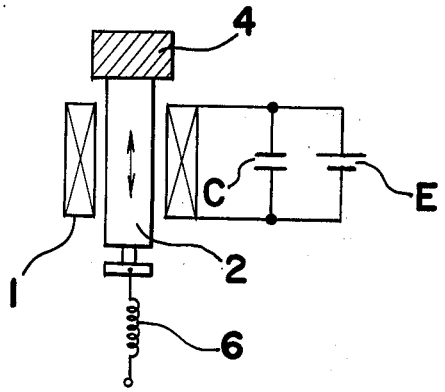
FIG. 1 is a diagrammatic view of an electromagnetically driven device which has already been referred to in the foregoing description.

In the following description of the invention like parts are designated by like reference numerals throughout the accompanying drawings.

The principle of an electromagnetically driven device of the present invention will first be described with reference to FIG. 2. The electromagnetically driven device of the present invention includes a solenoid unit having an electromagnetic coil 1 and a plunger 2 made of magnetic material and movable between an inserted position as shown and an ejected position. One end portion of the plunger 2, formed with a reduced diameter portion or a neck portion 2*b*, is connected with a biasing spring 6 which is provided for urging a plunger 2 towards the ejected position. The neck portion 2*b* is provided for connecting a lever (not shown) which transfers the movement of the plunger 2 to an operating device as will be described later with reference to FIG. 12. An armature 3 made of magnetic material is provided adjacent one end of the solenoid unit remote from the spring 6 such that an inner end 2*a* of the plunger 2 remoted from the neck portion 2*b* comes into contact with the armature 3 when the plunger 2 is moved to its inserted position. A permanent magnet 4 is held in contact with the armature 3 for magnetizing the armature 3. The magnet 4 is formed as a thin plate and made of rare earth cobalt given by $RCo_5$ wherein R represents yttrium Y or rare earth metal such as samarium Sm and cerium Ce. According to a preferable arrangement, the armature 3 is formed in a plate shape with its one flat surface held in contact with a polar surface, such as a north pole surface, of the permanent magnet 4 while its other flat surface faces the end 2*a* of the plunger 2. A yoke 5 having substantially a U-shaped configuration and made of magnetic material is provided for supporting the solenoid unit, armature and permanent magnet, and also for establishing a magnetic circuit. More specifically, one end of the yoke 5 is connected to other polar surface, i.e., south pole surface, while the other end of the yoke 5 is slidingly connected to a portion of the plunger 2 adjacent the neck portion 2*b*. It is to be noted that the armature 3 is also held in contact with or positioned closely adjacent a substantially intermediate portion of the yoke 5 for establishing a magnetic circuit therebetween.

During deenergization of the electromagnetic coil 1, the plunger 2 is held in the inserted position by the attraction of the permanent magnet 4 against the biasing spring 6. When the electromagnetic coil 1 is energized, the attractive force from the armature 3 acting on the plunger 2 is counterbalanced with the magnetic force generated by the coil 1. In other words, the plunger 2 is magnetized in such a manner that its end 2*a* facing the armature 3 is polarized with the same pole as the pole on the surface of the armature 3 facing the solenoid unit. According to the example shown in FIG. 2, the end 2*a* is polarized with north pole. Therefore, the attractive force between the armature 3 and the plunger 2 is reduced, to cause the plunger 2 to move towards the ejected position by the biasing force of the spring 6.

Figure 2:
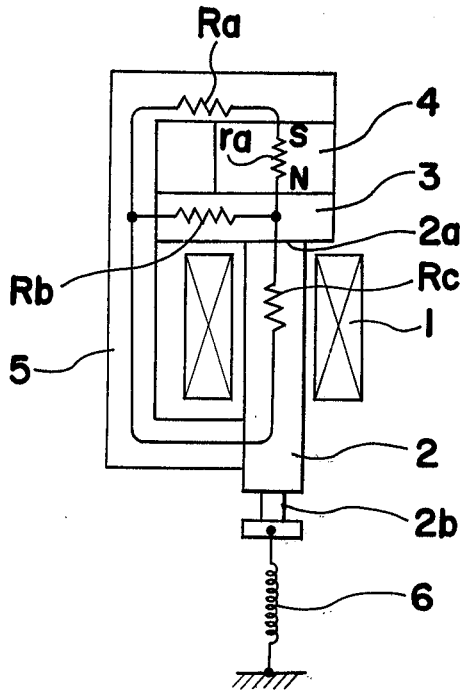
FIG. 2 is a diagrammatic view of an electromagnetically driven device of the present invention.
Figure 3:
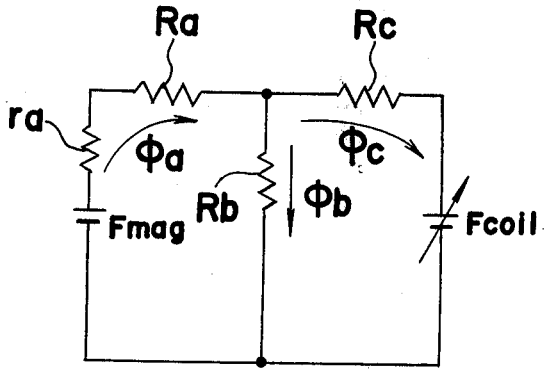
FIG. 3 is a magnetic circuit diagram established in the electromagnetically driven device of FIG. 2.

A magnetic circuit of the magnetically driven device is diagrammatically drawn in FIG. 2, in which the reference characters Ra, Rb, Rc and ra designate reluctances of the yoke 5, armature 3, plunger 2 and permanent magnet 4, respectively. Since the permanent magnet 4 and the electromagnetic coil 1 generate magnetic flux, they can be considered as sources Fmag and Fcoil of magnetomotive force. FIG. 3 shows an equivalent magnetic circuit of the magnetically driven device described above, in which reference characters Φa, Φb and Φc designate flux passing through the yoke 5, armature 3 and plunger 2, respectively. The reason that the magnetomotive force source Fcoil is shown as to be variable is because the magnetomotive force of the coil 1 changes with change in electric current flowing therethrough. For example, when no current is supplied to the coil, that is, when the plunger 2 is in the inserted position, electromagnetic coil 1 generates no magnetic flux, thus Fcoil =0.

It is understood that the magnetic flux Φc which influences the attractive force between the armature 3 and the plunger 2 can be expressed as follows:

$$\Phi c = \frac{Fmag \cdot Rb - Fcoil \cdot (Ra + ra + Rb)}{(Ra + ra) \cdot Rb + Rb \cdot Rc + Rc \cdot (Ra + ra)} \quad (1)$$

When the coil 1 is not energized, that is, when Fcoil =0, the plunger 2 is held in contact with the armature 3. If the necessary flux passing through the end 2*a* of the plunger 2 for holding the plunger 2 in contact with the armature 3 is selected to be Φo, the necessary magnetomotive force Fmag of the permanent magnet 4 can be expressed as follows:

$$Fmag = \frac{(Ra + ra) \cdot Rb + Rb \cdot Rc + Rc \cdot (Ra + ra)}{Rb} \cdot \Phi O \quad (2)$$

Similarly, the necessary magnetomotive force Fcoil to be generated from the coil 1 for counterbalancing the attractive force between the plunger 2 and the armature 3 is determined by the following equation (3):

$$Fcoil = \frac{(Ra + ra) \cdot Rb + Rb \cdot Rc + Rc \cdot (Ra + Ra)}{(Ra + ra) + Rb} \cdot \Phi o \quad (3)$$

Figure 4:
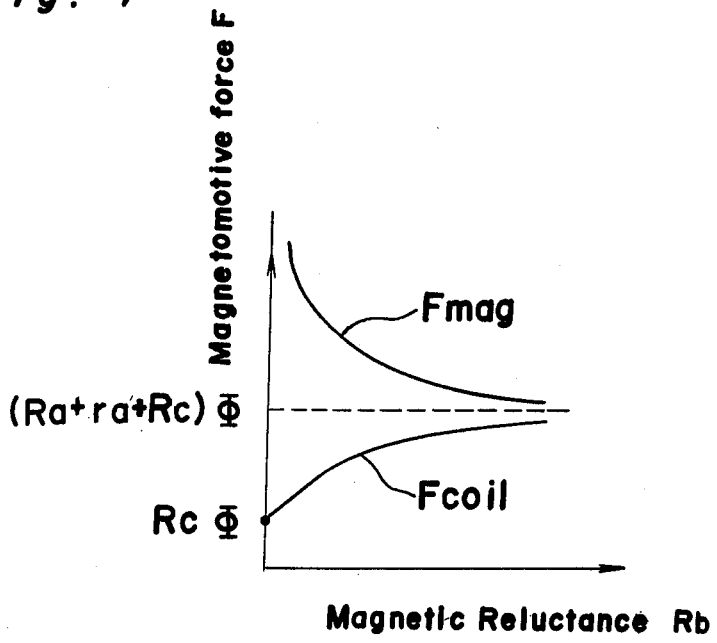
FIG. 4 is a graph showing the change of magnetomotive forces with respect to the change of reluctance Rb.

The relations between the reluctance Rb and the magnetomotive forces Fmag and Fcoil are shown in a graph of FIG. 4. As apparent from the graph, the magnetomotive force Fcoil takes a maximum value (Ra+ra+Rc)·Φo when the reluctance Rb is increased to infinite ∞, that is obtained when the magnetic circuit between the armature 3 and the yoke 5 is opened. In this case, the magnetomotive force Fcoil is approximately equal to the magnetomotive force Fmag of the permanent magnet 4.

On the other hand, the magnetomotive force Fcoil takes a minimum value Rc·Φo when the reluctance Rb is decreased to zero, that is obtained when the magnetic circuit between the armature 3 and the yoke 5 is short circuited. In this case, the magnetomotive force Fmag becomes infinite ∞. This means that the higher is the magnetomotive force Fmag required, the larger the size of the permanent magnet 4 must be.

When the above facts are taken into consideration, the reluctance Rb should not be infinite nor zero but should be an appropriate intermediate value determined relative to the interrelation between the magnetomotive forces Fmag and Fcoil. As understood to those skilled in the art, the reluctance Rb has an important character in the magnetic circuit described above. In other words, if the reluctance Rb is set to an appropriate value, it is possible to design an electromagnetically driven device which is compact in size and operates with a small amount of current for the solenoid. Thus, a capacitor to be coupled with an electric power source, such as a battery, for operating the solenoid can have a small capacitance. Therefore, the charging time of the capacitor is considerably short, and thus, the time interval between two sequential operations of the solenoid can be shortened. Furthermore, the solenoid can be operated with relatively low voltage. Thus, the electromagnetically driven device according to the present invention can be used even after the battery is consumed to some degree or under the low temperature.

Since the reluctance Rb establishes a bypass circuit for the flux from the permanent magnet 4, the reluctance Rb is referred to as a bypass reluctance Rb.

Figure 5:
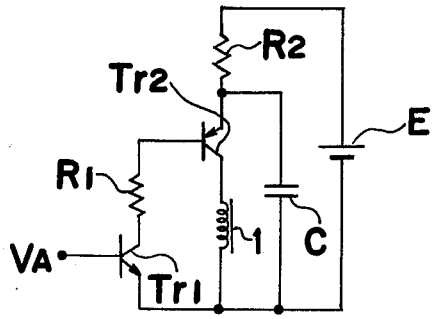
FIG. 5 is an electric circuit diagram for energizing a coil employed in the electromagnetically driven device of FIG. 2.

Referring to FIG. 5, there is shown an electric circuit which is designed for applying current to the electromagnetic coil 1. The circuit comprises a transistor Tr1 having its base connected to an input terminal VA. The collector of the transistor Tr1 is connected through a resistor R1 to the base of a transistor Tr2. The coil 1 is connected between the collector of the transistor Tr2 and the emitter of the transistor Tr1. A capacitor C is connected across the series connection of the transistor Tr2 and the coil 1, and a series connection of a resistor R2 and a source of power such as a battery E is connected in parallel to the capacitor C.

When the input terminal VA is not receiving any signal, the transistor Tr1 is maintained off and thus, the transistor Tr2 is maintained off. In this condition, the capacitor C is being charged by the battery E.

On the other hand, when a signal is applied to the input terminal VA, the transistor Tr1 is turned on for allowing an electric current to flow through the resistor R2 and the base of the transistor Tr2, thus tuning the transistor Tr2 on. When the transistor Tr2 is turned on, a current flows through the coil 1 from the charged capacitor C. This current flowing through the coil 1 by the discharge of the capacitor C causes the coil 1 to generate the above mentioned magnetomotive force Fcoil which is counterbalanced with the magnetomotive force Fmag of the permanent magnet 4, thereby reducing the attractive force between the armature 3 and the plunger 2. Thus, the plunger 2 which has been held in the inserted position is shifted to the ejected position by the biasing force of the spring 6.

Since the coil 1 according to the present invention can be so designed as to be energized with a considerably small amount of current, the coil 1 can be energized by the current from the battery E. In this case, it is not necessary to use the capacitor C. The current to be applied to the coil 1 is preferably in the form of pulses.

Figure 6:
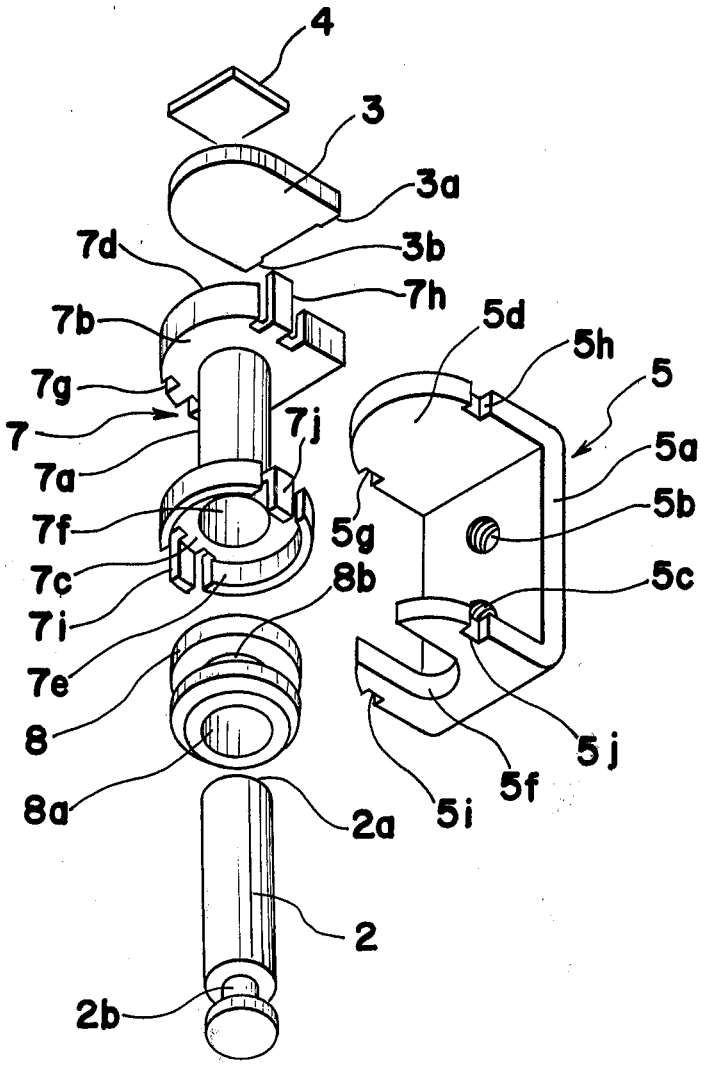
FIG. 6 is an exploded perspective view of the electromagnetically driven device in one embodiment of the present invention.

Referring to FIG. 6, one embodiment of the electromagnetically driven device of the present invention is shown. The device comprises a main yoke 5 having a main plate 5*a* and two support plates 5*d* and 5*e* extending respectively from and at right angles to the opposite ends of the main plate 5*a* in face-to-face relation with each other. The main plate 5*a* has two threaded holes 5*b* and 5*c* for the attachment to a frame (not shown). The support plate 5*d* has two engagement recesses 5*g* and 5*h* which are located on the opposite sides of the support plate 5*d*. Similarly, the support plate 5*e* has two engagement recesses 5*i* and 5*j* on the opposite sides of the plate 5*e*. The plate 5*e* further has a U-shaped recess 5*f* for fittingly receiving a guide yoke 8 having a through-hole 8*a* and a neck portion 8*b*. The main yoke 5 and the guide yoke 8 are made of magnetic material.

A bobbin 7 for the support of the coil 1 thereon has a cylindrical body portion 7*a* formed with a through-hole 7*f* and flanges 7*b* and 7*c* at the opposite ends of the cylindrical body portion 7*a*. The flange 7*b* is partly surrounded by a frame 7*d* including arms 7*g* and 7*h*. It is to be noted that these arms 7*g* and 7*h* engage in the recesses 5*g* and 5*h*, respectively. Before placing the support plate 5*d* on the flange 7*b*, the armature 3 and the permanent magnet 4 are placed on the flange 7*b* inside the frame 7*d*. In other words, the permanent magnet 4 and the armature 3 are sandwiched between the flange 7*b* and the support plate 5*d* in an assembled condition.

Since the armature 3 completely closes one end of the through-hole 7*f* of the bobbin 7, dust and small particles can be prevented from being intruded into a room defined between the armature 3 and end 2*a* of the plunger 2.

According to one preferable arrangement, the armature 3 has two projections 3*a* and 3*b* on one side edge thereof. These projections 3*a* and 3*b* are held in contact with the main plate 5*a* of the main yoke 5. The other flange 7*c* is surrounded by a frame 7*e* which includes arms 7*i* and 7*j*. These arms 7*i* and 7*j* engage in the recesses 5*i* and 5*j*, respectively, of the yoke 5. The frame 7*e* fittingly receives the guide yoke 8 with the through-hole 8*a* held in alignment with the through-hole 7*f*. It is to be noted that the bobbin 7 is made of non-magnetic material.

Figure 7:
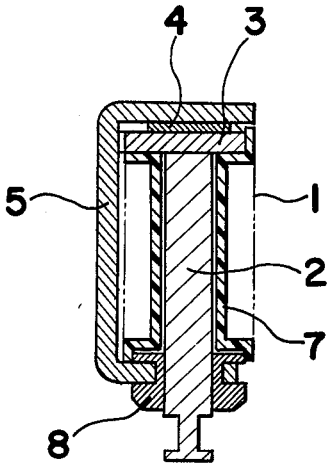
FIG. 7 is a cross-sectional view of the electromagnetically driven device of FIG. 6 in an assembled condition.

The plunger 2 is inserted into the through-hole 7*f* of the bobbin 7 through the through-hole 8*a* of the guide yoke 8, as best shown in FIG. 7. The plunger 2 takes the inserted position when the end face 2*a* of the plunger 2 contacts the armature 3. For obtaining a predetermined contact pressure between the armature 3 and the yoke 5, the arms 7*g* and 7*h* may be suitably tilted for biasing the main plate 5*a* towards the bobbin 7.

It is to be noted that the guide yoke 8 is operable to pass magnetic flux in the main yoke 5 from the permanent magnet to the plunger 2 thereby enabling the plunger 2 to return automatically from its ejected position to inserted position when the current for energizing the coil 1 is cut off. When the coil 1 is deenergized during the plunger 2 being in the ejected position, the permanent magnet 4 magnetizes, through the main yoke 5 and the guide yoke 8, the end face 2*a* of the plunger 2 to the same pole as that appearing on the permanent magnet surface held in contact with the yoke 5. Since the surface of the armature 3 facing the plunger 2 is also magnetized to the opposite pole, the plunger 2 is pulled inwardly of the coil 1 by the attractive force between the armature 3 and the plunger 2.

It is also to be noted that the guide yoke 8 can be eliminated in the case where the plunger 2 can be returned back to the inserted position by an external pushing force as in a manner described later with reference to FIG. 12.

As mentioned above, the bypass reluctance Rb is an important value for determining the magnetomotive forces Fmag and Fcoil, that is, for determining the sizes of the permanent magnet 4 and the coil 1. Since the required magnetomotive forces Fmag and Fcoil may vary with the type of devices to be connected to the plunger, it is necessary to adjust the bypass reluctance Rb to a preferable value in each model of the electromagnetically driven device. For this purpose, FIGS. 9(*a*) to 9(*j*) show various method by which the bypass reluctance Rb can be adjusted.

Figure 9:
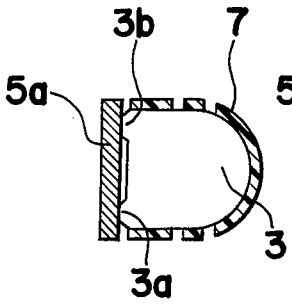
FIGS. 9(*a*) to 9(*d*) and FIG. 9(*k*) are cross-sectional views taken along the line IX—IX shown in FIG. 8, showing various methods for controlling the reluctance Rb.
Figure 9:
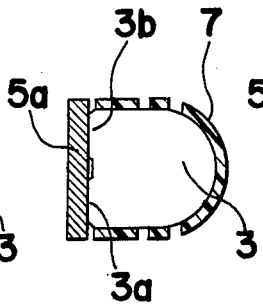
Figure 9:
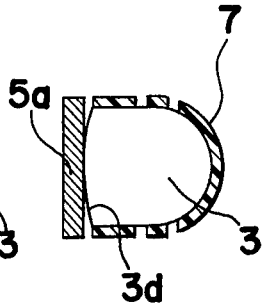
Figure 9:
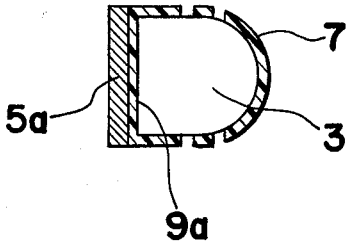
Figure 9E:
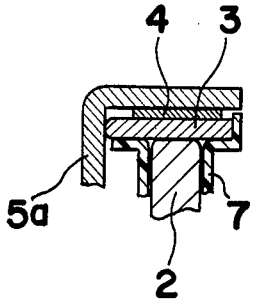
Figure 9F:
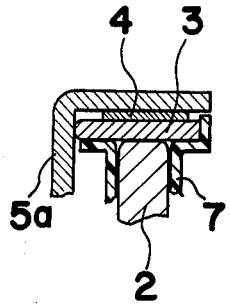
Figure 9G:
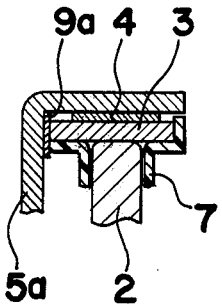
Figure 9H:
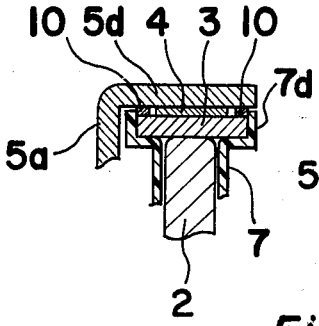
Figure 9I:
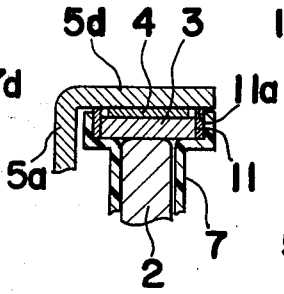
Figure 9:
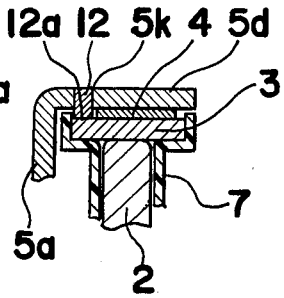
Figure 9:
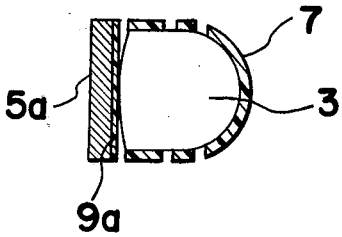

Referring to FIGS. 9(*a*) to 9(*c*), the bypass reluctance Rb is adjusted by the area of the armature 3 which contacts the main plate 5*a* of the main yoke 5. More particularly, FIGS. 9(*a*) and 9(*b*) show the case wherein each of the projections 3*a* and 3*b* is widened or narrowed for changing the contacting area. And, FIG. 9(*c*) shows the case wherein the contacting edge of the armature 3 is rounded. The degree of curvature determines the area of the armature 3 which is held in contact with the main plate 5*a*.

Referring to FIG. 9(*d*), the bypass reluctance Rb is adjusted by the presentation of a sheet 9*a* having a small magnetic permeability such as a non-magnetic material, or a semi-hard material between the armature 3 and the main plate 5*a*. In this case, the thickness of the sheet 9*a* as well as the magnetic permeability of the sheet 9*a* determines the bypass reluctance Rb. It is to be noted that the sheet 9*a* may be formed integrally together with the bobbin 7, as a part of the frame 7*d*, as shown in FIG. 9(*d*) or the sheet 9*a* can be provided independently of the bobbin 7, as shown in FIG. 9(*g*).

FIGS. 9(*e*) and 9(*f*) show other methods for adjusting the bypass reluctance Rb by the design of the contacting area between the armature 3 and the main plate 5*a*. More particularly, FIG. 9(*e*) shows the case wherein the contacting edge of the armature 3 is beveled or tapered in the thickness direction, while FIG. 9(*f*) shows the case wherein the contacting edge of the armature 3 is rounded in the thickness direction.

FIGS. 9(*h*) to 9(*i*) show the respective cases in which the armature 3 is held in contact with the support plate 5*d* of the main yoke 5 through a contacting member. In FIG. 9(*h*), a frame-shaped contacting member 10 having a thickness slightly thicker than that of the permanent magnet 4 is positioned between the upper surface of the armature 3 and the support plate 5*d*. The reluctance Rb is adjusted by the change of the area of the contacting member 10 which contacts with the armature 3 and with the support plate 5*d*, and also by the magnetic permeability of the contacting member 10. Preferably, the contacting member 10 is made of soft material or semi-hard material. Instead of providing the frame-shaped contacting member 10 around and in spaced relation to the permanent magnet 4, FIG. 9(*i*) shows the case in which a frame-shaped member 11 is fittingly provided around the armature 3. The end face 11*a* of the member 11 is held in contact with the support plate 5*a*.

FIG. 9(*j*) shows the case in which a pin 12 made of magnetic material is fittingly inserted into an opening 5*k* formed in the support plate 5*d*. One end 12*a* of the pin 12 which is located under the support plate 5*d* is held in contact with the armature 3. For adjusting the reluctance Rb, the size, such as a diameter, of the pin 12 may be changed or the end 12*a* of the pin 12 may be tapered or rounded.

Since bypass circuit for the bypass reluctance Rb in any one of the modifications in FIGS. 9(*h*) to 9(*j*) is established between the armature 3 and the support plate 5*d*, it is not necessary to establish any other bypass circuit between the side edge of the armature 3 and the main plate 5*a*. Therefore, in the modifications of FIGS. 9(*h*) to 9(*j*), the armature 3 can be completely surrounded by the frame 7*d* as shown.

It is to be noted that the above methods for adjusting the reluctance Rb is not limited to those described above with reference to FIGS. 9(*a*) to 9(*j*), but any other methods can be used. Furthermore, a combination of any two or more of the methods can be used. For example, the modifications of FIGS. 9(*a*) and 9(*e*) may be employed at the same time, or the modifications of FIGS. 9(*c*) and 9(*g*) may be employed at the same time as shown in FIG. 9(*k*).

When the electromagnetically driven device of the present invention is to be manufactured by the use of any one of the above described methods, there may be the possibility that the armature 3 and the main plate 5*a* are displaced in position relative to each other to such an extent as to result in an undesirable change in bypass reluctance Rb unless the armature 3 and the main plate 5*a* are held together under a predetermined contact pressure. Naturally, change in bypass reluctance Rb means variation in attraction characteristic between the armature 3 and the plunger 2.

Figure 8:
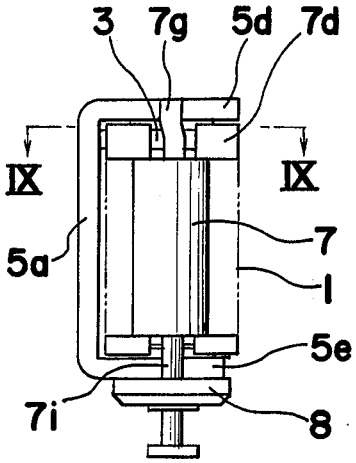
FIG. 8 is a side elevational view of the electromagnetically driven device of FIG. 6 in the assembled condition.

The above described possibility, however, can advantageously be eliminated by, as shown in FIG. 8, forcing the arms 7*g* and 7*h* to bend against their own resiliency when the arms 7*g* and 7*h* are respectively engaged in the recesses 5*g* and 5*h* to connect the bobbin 7 to the main yoke 5 with the armature 3 and the magnet 4 held between the frame 7*d* and the support plate 5*d*. By so doing, the arms 7*g* and 7*h* so engaged in the respective recesses 5*g* and 5*h* and tending to restore to their original shape exert a biasing force to urge the bobbin 7 against the yoke 5 and, consequently, the armature 3 is held assuredly in contact with the main plate 5*a* under a predetermined contact pressure.

Figure 10A:
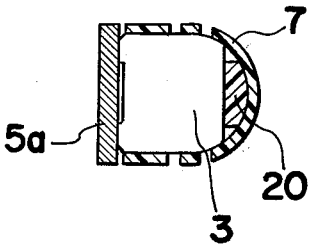
FIGS. 10(*a*) to 10(*c*) are views similar to FIG. 9(*a*), but particularly showing methods for biasing an armature towards a yoke.
Figure 10B:
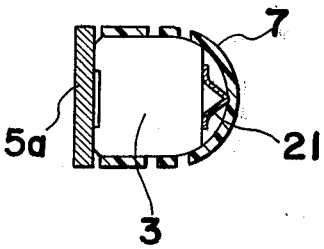

The method of giving the predetermined contact pressure between the armature 3 and the main plate 5*a* of the yoke 5 is not limited to that described above and shown in FIG. 8, but any one of other methods such as shown in FIGS. 10(*a*) and 10(*b*) may be employed singly or in combination with the above described method.

Referring to FIG. 10(*a*), an elastic material such as a rubber 20 is held in a space between the edge of the armature 3 remote from the main plate 5*a* and the frame 7*d* of the bobbin 7 so that when the bobbin 7 and the yoke 5 are held together, the rubber 20 pushes the armature 3 towards the main plate 5*a* to cause the armature 3 to contact the plate 5*a* under the predetermined pressure.

Instead of the elastic material such as shown in FIG. 10(*a*), in the example shown in FIG. 10(*b*), a leaf spring 21 is employed. This spring 21 is held in the space between the edge of the armature 3 and the frame 7*d*. In any event, the method shown in any one of FIGS. 10(*a*) and 10(*b*) may equally be applicable to any one of the other modifications of FIGS. 9(*b*) to 9(*g*).

Figure 11:
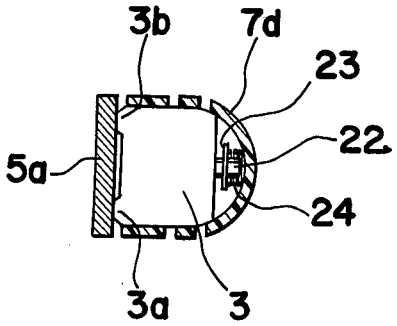

The arrangements described above with reference to FIGS. 9(*a*) to 10(*b*) are mainly directed to a method of fixing the reluctance Rb of a value required to set a predetermined attraction characteristic between the armature 3 and the plunger 2. However, if the reluctance Rb is desired to be adjusted to a desired value, this can be accomplished by changing selectively the attraction characteristic between the armature 3 and the plunger 2, specifically either by changing the contact pressure or contact area between the armature 3 and the yoke 5, or by suitably selecting the material to be disposed between the armature 3 and the yoke 5. FIG. 11 shows an example in which the reluctance Rb is adjusted by changing the contact pressure.

Referring to FIG. 11, the armature 3 is fixedly provided with a threaded projection 22 on the edge opposite to the edge held in contact with the main plate 5*a*. A ring 23 having a threaded opening is screwed onto the projection 22 for supporting a biasing spring 24 between the ring 23 and the frame 7*d*. Screwing in and out of the ring 23 changes the biasing force of the spring 24, thus changing the contact pressure between the main plate 5*a* and the projections 3*a* and 3*b*.

Figure 12:
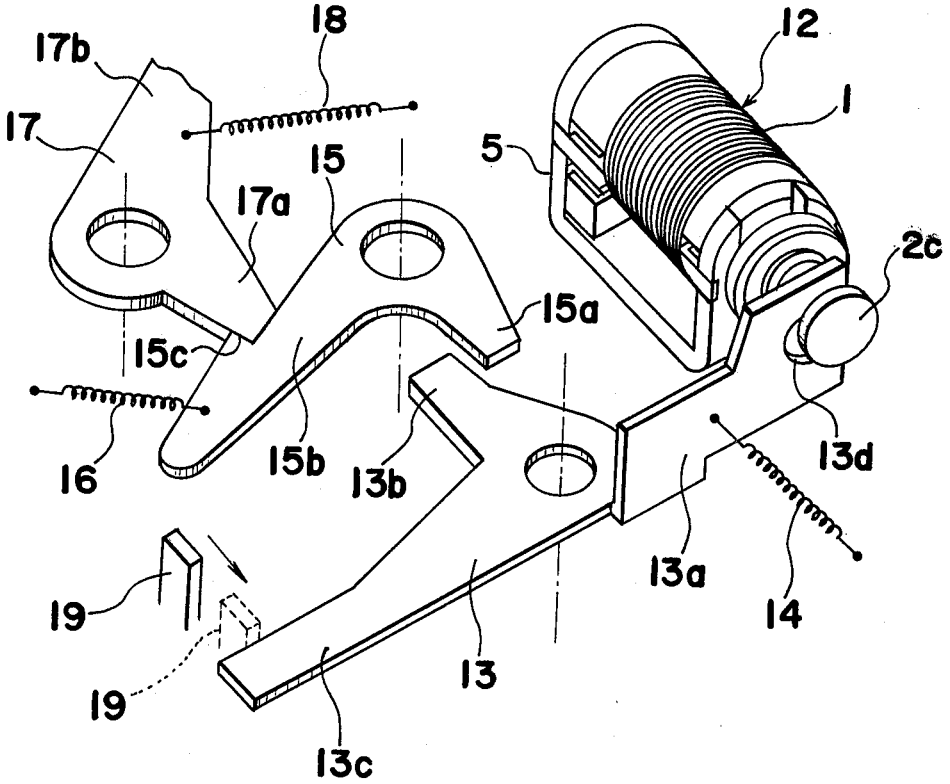
FIG. 12 is a perspective view showing one arrangement for effecting an external device by the actuation of the electromagnetically driven device of the present invention.

Referring to FIG. 12, there is shown an example in which the electromagnetically driven device of the present invention is employed for actuating a shutter mechanism in a photographic device. A first lever 13 having three arms 13*a*, 13*b* and 13*c* is pivotally mounted at a substantially intermediate portion on a pin (not shown), and is normally biased in a clockwise direction by spring 14. The arm 13*a*, which is an elongated plate positioned in parallel to a pivotal axis, has a U-shaped recess 13*d* engaged to the neck portion 2*b* of the plunger 2. A second lever 15 having two arms 15*a* and 15*b* is pivotally mounted on a pin (not shown) and is so positioned and so operatively associated with the first lever 13 that the pivotal movement of the lever 13 in the clockwise direction can be transmitted from the arm 13*b* to the arm 15*a* thereby causing a pivotal movement of the second lever 15 in a counterclockwise direction against a spring 16 used to bias the lever 15 towards a clockwise direction. A third lever 17 having two arms 17*a* and 17*b* is also pivotally mounted on a pin (not shown) and is so positioned and so operatively associated with the second lever 15 that the second lever 15 normally holding the third lever 17 in an engaged position by the engagement between a hook 15*c* of the second lever 15 and the arm 17*a*, can be disengaged from the third lever 17 when the second lever 15 is pivoted counterclockwise against the spring 16. The disengagement of the lever 17 from the hook 15*c* results in a pivotal movement of the lever 17 in a clockwise direction by the action of a spring 18 connected to the lever 17 and used to bias the lever 17 in a clockwise direction. The arm 17*b* of the third lever 17 is connected to a shutter mechanism (not shown) such as a focal-plane shutter and to an aperture controlling mechanism. The operation of the shutter mechanism is explained below.

When the plunger 2 which has been in the inserted position is shifted to the ejected position upon energization of the coil 1 and by the action of the spring 14 with the lever 13 pivoting clockwise, the arm 13*b* of the lever 13 while engaged to the arm 15*a* of the lever 15 pushes the lever 15 to cause the latter to pivot counterclockwise against the spring 16 with the hook 15*c* disengaging from the arm 17*a* of the lever 17. Upon disengagement of the hook 15*c* from the arm 17*a* so effected, the lever 17 is rotated clockwise with the arm 17*b* consequently actuating a reflecting mirror (not shown) on one hand and, on the other hand, to cause the shutter mechanism to carry out a photographic exposure. After the exposure, i.e., after the trailing curtain forming a port of the shutter mechanism has completed its movement in pursuit of the leading curtain also forming a part of the shutter mechanism, a lever 19 is operated in response to a mechanical signal indicative of the completion of operation of the shutter mechanism to rotate the first lever 13 counterclockwise thereby returning the plunger 2 from its ejected position to the inserted position. Since the lever 19 effects the return of the plunger 2 back to its inserted position, it is not necessary to provide the guide yoke 8 in this application.

Since the electromagnetically driven device of the present invention includes a magnetic circuit which bypasses the plunger 2 for obtaining the predetermined attraction characteristic between the armature 3 and the plunger 2, it is possible to reduce the capacitance of the capacitor for the current to be supplied to the coil 1. Furthermore, the time interval between the two sequential operations can be shortened. Moreover, the voltage from the source can be reduced.

Although the present invention has been fully described by way of examples with reference to the accompanying drawings, it is to be noted that various changes and modifications are apparent to those skilled in the art. Therefore, such changes and modifications are, unless they depart from the true scope of the present invention, to be understood as included therein.

What is claimed is:

1. An electromagnetically driven device comprising:

a coil adopted to be energized by the application of an electric power thereto;

a plunger made of magnetic material and inserted in the hollow of the coil for movement in an axial direction of the hollow of the coil between an inserted position and an ejected position;

an armature made of magnetic material and having first, second and third faces, said first face of the armature being positioned to confront with one end of the coil, one end of the plunger contacting said first face of the armature when said plunger is moved to its inserted position;

a permanent magnet having first and second polar faces, said first polar face of the permanent magnet being held in contact with the second face of the armature for magnetizing the armature, said plunger being held in the inserted position, when said coil is deenergized, by a magnetic attractive force developed between the first face of the armature and the plunger, and said plunger being released from the magnetic attractive force in readiness for movement from the inserted position towards the ejected position when said coil is energized to counterbalance said magnetic attractive force;

a yoke made of a magnetic material and arranged for establishing a main magnetic circuit for the magnetic flux generated by said coil and said permanent magnet, and a bypass magnetic circuit for the magnetic flux generated by said permanent magnet, said main magnetic circuit being established through said yoke, said first and second faces of said armature and said first and second polar faces of said permanent magnet while said bypass magnetic circuit is established through said yoke, said second and third faces of said armature and said first and second polar faces of said permanent magnet;

means for presenting a predetermined reluctance between the third face of the armature and said yoke for bypassing predetermined flux emanated from the first polar face of the permanent magnet through the armature and the yoke without passing through the plunger to control the magnetic attractive force between the first face of the armature and the plunger.

2. An electromagnetically driven device as claimed in claim 1, wherein said presenting means is said third face of the armature held in contact with the yoke.

3. An electromagnetically driven device as claimed in claim 2, wherein said predetermined reluctance is determined by the area of surface of the third face of the armature.

4. An electromagnetically driven device as claimed in claim 3, wherein said third face of the armature is flat.

5. An electromagnetically driven device as claimed in claim 3, wherein said third face of the armature is curved at a predetermined curvature.

6. An electromagnetically driven device as claimed in claim 2, wherein said predetermined reluctance is determined by the pressure between the third face of the armature and the yoke.

7. An electromagnetically driven device as claimed in claim 1, 2, 3, 4, 5 or 6, wherein said presenting means includes a non-magnetic material inserted between said third face and the yoke.

8. An electromagnetically driven device as claimed in claim 1, further comprising a bobbin made of non-magnetic material for the support of said coil, said bobbin having an opening formed in its axial direction for the insertion of the plunger, said bobbin further having a support plate at its one end for supporting said armature therein.

9. An electromagnetically driven device as claimed in claim 8, wherein said armature is of a plate-like configuration, said first and second faces of the armature being flat and opposed to each other and said third face of the armature being a portion of side face of the armature, said first face of the armature completely closing one end of said opening of the bobbin provided with the support plate, and said support plate having a frame which is confronted with one side face of the armature opposed to said portion of said side face.

10. An electromagnetically driven device as claimed in claim 9, further comprising means for biasing said armature towards the yoke for producing a predetermined pressure between the third face of the armature and the yoke.

11. An electromagnetically driven device as claimed in claim 10, wherein said biasing means is resilient arm means extending from the bobbin, free end of said arm means being engaged to the yoke.

12. An electromagnetically driven device as claimed in claim 10, wherein said biasing means is an elastic material positioned between said one side face of the armature and said frame.

13. An electromagnetically driven device as claimed in claim 10, wherein said biasing means is an spring means positioned between said one side face of the armature and said frame.

14. An electromagnetically driven device as claimed in claim 8, wherein said armature is of a plate-like configuration having opposite flat surfaces, said first face of the armature included in one of said opposite flat surfaces and said second and third faces of the armature included in the other of said opposite flat surfaces, and said presenting means includes a soft or semi-hard material inserted between said third face and the yoke.

15. An electromagnetically driven device as claimed in claim 1, further comprising an urging means for urging said plunger towards said ejected position, said urging means adopted to move said plunger from the inserted position to the ejected position when said coil is energized.

16. An electromagnetically driven device as claimed in claim 1, wherein said yoke slidingly supports the plunger at other end of the coil remote from the armature.

* * * * *